United States Patent [19]

Thomas

[11] Patent Number: 4,723,752

[45] Date of Patent: Feb. 9, 1988

[54] FORM BRACE

[76] Inventor: Ward H. Thomas, 5233 IH 37, Suite 1, Corpus Christi, Tex. 78409

[21] Appl. No.: 826,735

[22] Filed: Feb. 6, 1986

[51] Int. Cl.[4] ..... E04G 17/14; E01C 19/50

[52] U.S. Cl. ..... 249/219 R; 249/4; 249/208

[58] Field of Search ..... 249/2–8, 249/23, 24, 28, 29, 50, 205, 207, 208, 211, 219 R; 248/242, 351; 52/127.2; 405/284

[56] References Cited

U.S. PATENT DOCUMENTS

| | | | |
|---|---|---|---|
| 839,496 | 12/1906 | Milam | 249/45 |
| 1,210,296 | 12/1916 | Fouse | 249/50 |
| 1,331,491 | 2/1920 | Ferguson | 269/203 |
| 1,560,494 | 11/1925 | Trester | 269/41 |
| 1,651,041 | 11/1927 | Richards | 269/43 |
| 2,413,569 | 12/1946 | Isakson | 248/351 |
| 2,483,758 | 10/1949 | Douglas | 248/242 |
| 2,741,821 | 4/1956 | Findley | 249/189 |
| 3,035,321 | 5/1962 | Hennig | 249/27 |
| 3,119,590 | 1/1964 | Eriksson | 248/240.3 |
| 3,154,832 | 11/1964 | Weidner | 249/10 |
| 3,583,666 | 6/1971 | Horstketter | 249/10 |

FOREIGN PATENT DOCUMENTS

| | | | |
|---|---|---|---|
| 548291 | 1/1958 | Italy | 249/219 R |

OTHER PUBLICATIONS

"Slabmaker I" sales brochure Medalist Forming Systems.

*Primary Examiner*—Jay H. Woo
*Assistant Examiner*—James C. Housel
*Attorney, Agent, or Firm*—G. Turner Moller

[57] ABSTRACT

A concrete form brace comprises a base having openings therein through which stakes are driven to immobilize the base relative to the ground. A form support is pivotally mounted to the base and engages conventional wooden concrete forms. A diagonal strut extends between the form support and the base. The strut is adjustable along an upstanding wall of the base between a variety of angular positions. A set screw secures the strut in any desirable position.

7 Claims, 7 Drawing Figures

FORM BRACE

This invention relates to an improved adjustable brace for concrete forms and the like which is reusable. This brace may be rapidly installed and removed and may be used with concrete forms of various sizes on level or sloping terrain.

When pouring concrete or the like, it is present practice to erect forms to contain the concrete into the desired shape until it sets up. These forms are typically of lumber and do not comprise a permanent part of the structure but are instead removed after the concrete has set up.

A typical concrete pouring operation involves a building foundation. In this situation, the earth at the site is dug up to form the desired underground shape of the finished concrete foundation. Removable wooden forms are placed about the periphery of the intended foundation to restrain the flowable concrete until it sets up. The present practice is to drive stakes or posts into the ground for supporting the form wall and to provide wooden struts wedged against the form wall for supporting it.

Because this technique is so wide spread, one would think that it is the most efficient, least costly technique available. Experience and analysis suggests, however, that substantial improvements in costs and productivity are possible. Every concrete contractor is continually buying form lumber that cannot be reused from job-to-job because it splits or is broken during placement or removal of the forms. Much of this form lumber is the wooden stakes driven into the ground and the inclined wooden struts. Perhaps twenty percent of these components of form lumber are damaged beyond reuse during each job. Every concrete contractor also knows that there is considerable effort expended in driving the wooden stakes in the ground, wedging the inclined struts into a bracing configuration and then removing these items after the concrete has set up. Because of these costs and the desire for productivity gains, attempts have been made to design and provide reusable metal concrete form braces which are simple to install and remove. Examples of such devices are found in U.S. Pat. Nos. 839,496; 1,331,491; 1,560,494; 1,651,041; 2,741,821; 3,119,590; 3,154,832; and 3,583,666. In addition, a similar device is apparently commercially available from Medalist Forming Systems of Windsor, Wis. It is not known exactly why these devices have not been more widely accepted. It can only be surmised that the total returns from using these devices, i.e. decreased material costs and increased productivity, did not substantially exceed the cost of buying maintaining and replacing these devices.

The improved concrete form brace of this invention comprises a base having a base member providing a long dimension, means for receiving a stake for securing the brace to the earth and an elongate upstanding guide member extending parallel to the long dimension, a form support pivotally connected to the base member for rotation about an axis generally perpendicular to the guide member, a strut pivotally connected adjacent one end thereof to the form support and having an adjustable connection at the other end thereof supported on and moveable relative to the upstanding guide member and means for securing the adjustable connection to the guide member at a multiplicity of locations there along.

More specifically, the form brace base of this invention comprises a length of a metal angle having a first generally planar section which resides along the ground and a second generally planar section perpendicular to the first section which stiffens the base and which provides the elongate upstanding guide member. The strut diagonally approaches the upstanding wall of the metal angle comprising the base and has thereon a downwardly facing generally U-shaped connection which slides along the top of the guide member. A set screw extends through one leg of the U-shaped structure and may be threadably tightened against the guide member wall to secure the strut at a desired inclination relative to the base.

It is accordingly an object of this invention to provide an improved reusable concrete form brace which is inexpensive to manufacture, which is readily assembled and disassembled, and which is sturdy and requires little maintenance.

Other and further objects of this invention will become more fully apparent as this description proceeds, reference being made to the accompanying drawings and appended claims.

Figure 1:
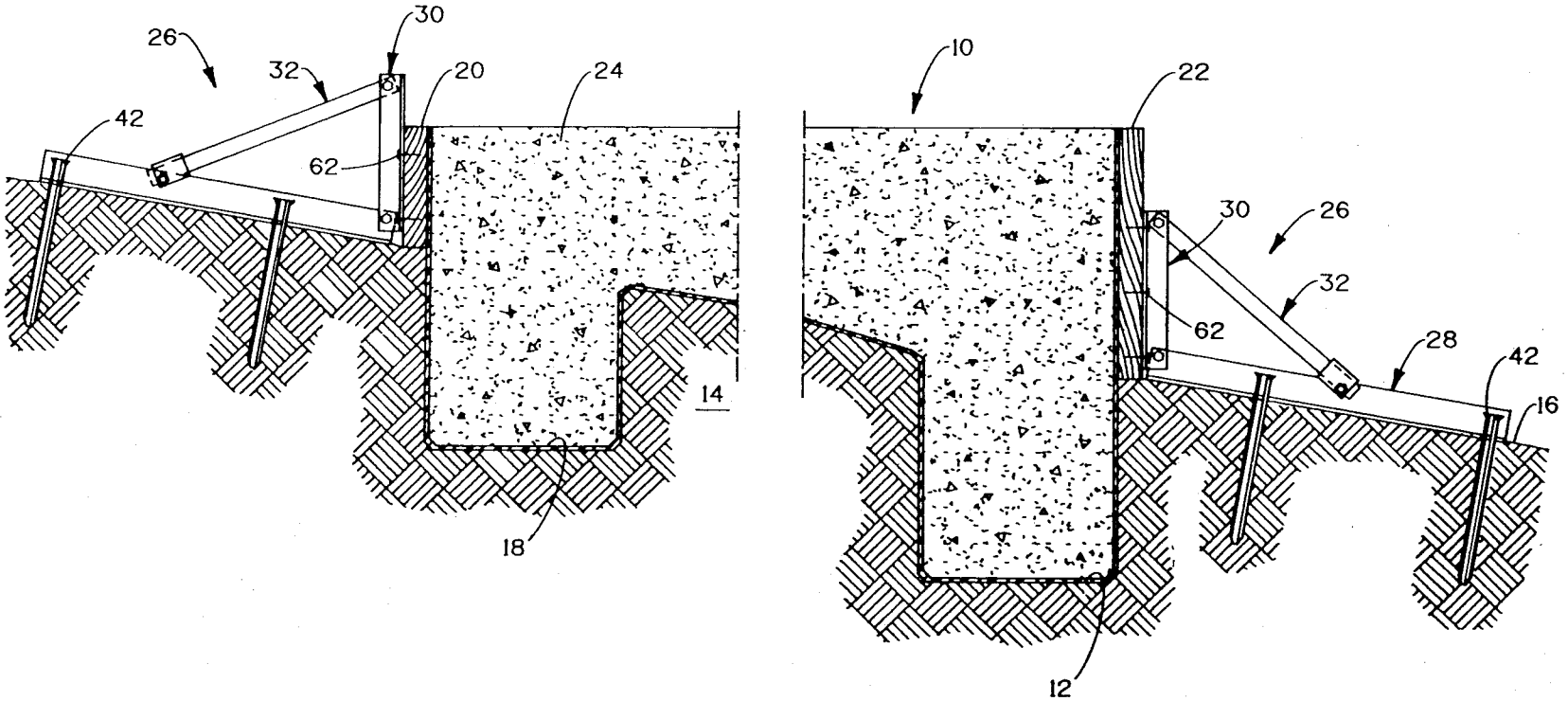
FIG. 1 is an enlarged cross-sectional view of a concrete foundation constrained by concrete forms supported by the form braces of this invention.

Referring to FIG. 1, there is illustrated a concrete foundation 10 which has been poured in an excavation 12 dug into the earth 14 in an area where the surface 16 slopes substantially. As is conventional, the excavation 12 has a plastic lining 18 therein. Wooden concrete forms 20, 22 act as temporary walls to support a concrete mass 24 above the ground level 16 and act to constrain the concrete 24 before it sets up. The concrete form braces 26 of this invention support the forms 20, 22 at spaced locations along the periphery of the foundation 10.

The form braces 26 comprise, as major components, a base 28, a form support 30 pivotally connected to the base 28 and a strut 32 pivotally connected to the form support 30 and being securable to the base 28 along at least part of the length thereof.

Figure 3:
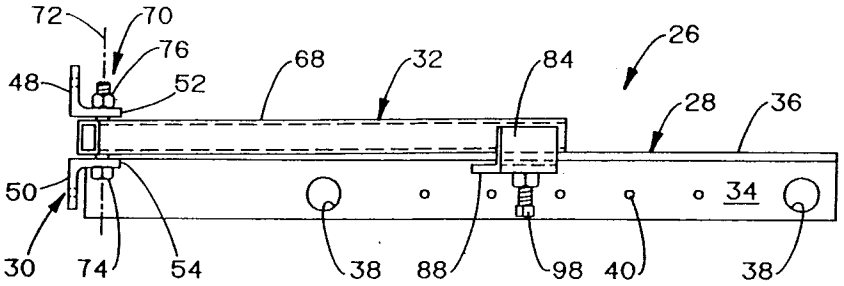
FIG. 3 is a top elevational view of the form brace of FIG. 2.
Figure 4:
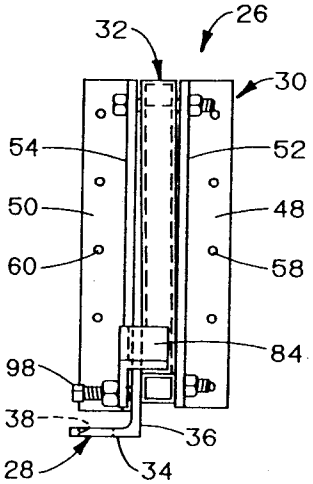
FIG. 4 is an end view of the form brace of FIGS. 2 and 3.
Figure 2:
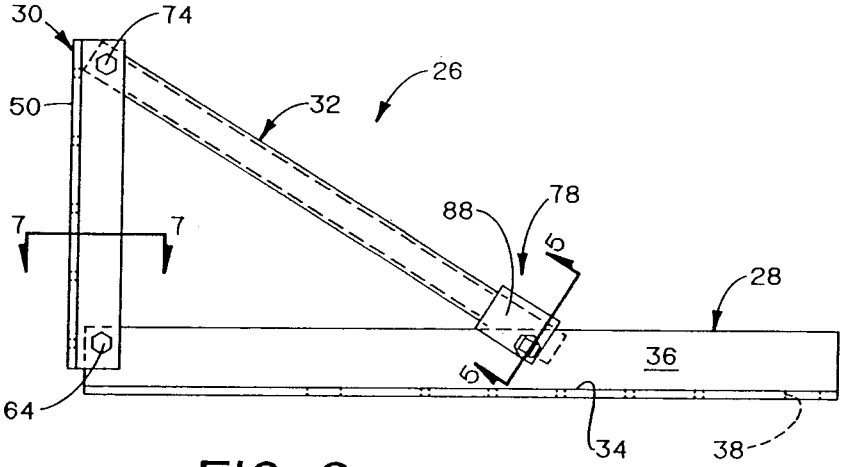
FIG. 2 is an enlarged side elevational view of the form brace of FIG. 1.

Referring to FIGS. 2–4, the base 28 comprises a length of metal angle having a base member 34 and an upstanding wall 36 perpendicular thereto which acts as a guide member for receiving and supporting one end of the strut 32. As will be evident to those skilled in the art, the upstanding wall 36 also stiffens the base member 34 against bending movement out of its normal generally planar shape. The base member 34 includes a long dimension generally parallel to the upstanding wall 36 which may be of any suitable length. In manfacture, the base member 34 is merely cut from a longer length of a material known as angle iron. One or more large openings 38 are formed in the base member 34 and a series of second, much smaller openings 40 are provided along the base member 34 parallel to the long dimension. In use, one or more stakes 42, preferably metal, are driven through the large openings 38 to secure the base 28 to the ground 14 and prevent shifting of the form braces 26 relative to the foundation 10. The smaller openings 40 are provided in the event it is desired to nail the base 28 to lumber between the brace 28 and the ground surface 16.

The form support 30 is pivotally connected for rotation about an axis 44 adjacent one end of the base 28 by a threaded connector 46. As best shown in FIGS. 2–4 and 7, the form support 30 comprises a pair of metal angles comprising a pair of co-planar base members 48, 50 and a pair of parallel upstanding walls 52, 54. At the base of the form support 30, the parallel walls 52, 54 are spaced apart by a sleeve 56 and the upstanding wall 36 of the base 28 as shown best in FIG. 7.

At the top of the form support 30, the walls 52, 54 are spaced apart by one end of the strut 32 as shown best in FIGS. 3 and 4. In order to keep the metal angles of the form support 30 generally parallel, it is preferred that the length of the sleeve 56 and the width of the upstanding wall 36 be about the same dimension as the width of the strut 32.

As seen best in FIGS. 1 and 4, the base members 48, 50 of the form support 30 are provided with a series of longitudinally spaced small openings 58, 60 for receiving nails 62 which secure the form support 30 to the wooden forms 20, 22. Double headed nails are preferred so they can be more easily extracted, as is well known to concrete contractors.

Figure 7:
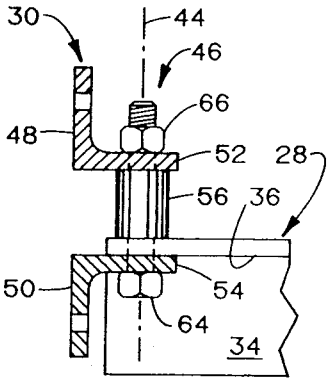
FIG. 7 is an enlarged cross-sectional view of the form brace of FIG. 2, taken substantially along line 7—7 thereof as viewed in the direction indicated by the arrows.

The threaded connector 46 is shown best in FIG. 7 and comprises the sleeve 56 and aligned openings in the upstanding walls 52, 54 and in the upstanding wall 36. A conventional bolt 64 extends through the aligned openings and sleeve 56 and a nut 66 cinches the assembly together.

The strut 32 preferably comprises a length of square metal tubing 68 having one end sandwiched between the upper ends of the upstanding walls 52, 54 of the form support 30 as shown best in FIG. 3. To this end, a threaded connection 70 pivotally connects the strut 32 to the form support 30 for movement about an axis 72. The threaded connection 70 comprises aligned openings in the upstanding walls 52, 54 and the tubing 68. A bolt 74 extends through the aligned openings and a nut 76 cinches the assembly together. As is evident, the width of the square tubing 68 is about the same as the combined length of the sleeve 56 plus the thickness of the wall 36.

On the opposite end of the strut 32 is a connector 78 providing a generally downwardly facing U-shaped slot 80 for receiving the guide member or upstanding wall 36 therein. To this end, the connector 78 comprises an angle type bracket 82 having a first leg 84 welded to the top of the square tubing 68 by weldments 86 and a downwardly extending leg 88 generally parallel to one side of the square tubing 68. It will accordingly be seen, as shown best in FIGS. 1 and 2, that the guide member, comprising the upstanding wall 36, is received in the slot 80 throughout a wide range of relative movement between the connector 78 and the guide member 36. In a model constructed in accordance with this invention, there is sufficient relative movement between the connector 78 and the guide member 36 to position the form support 30 in a range of movement between a first angle of about 30 degrees relative to the base 28 to a second angle of about 150 degrees relative to the base 28. It will be immediately evident to concrete contractors that this range of movement is far in excess of that required by concrete form braces. It will also be evident that the brace 26 of this invention is quickly moveable from one extremity to the other without requiring lengthy rotation of a long winded turnbuckle.

Figure 5:
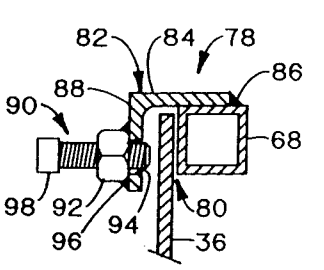
FIG. 5 is a cross-sectional view of the form brace of FIG. 2, taken substantially along line 5—5 thereof as viewed in the direction indicated by the arrows.
Figure 6:
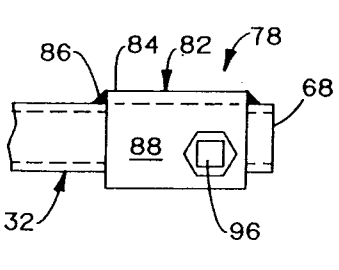
FIG. 6 is an enlarged side elevational view of the sliding connection of FIG. 5.

In order to secure the connection 78 at any desired location along the guide member 36, a set screw arrangement 90 is provided as shown best in FIG. 5. The set screw arrangement 90 comprises a nut 92 secured to the leg 80 coaxial with an opening 94 therein. Weldments 96 secure the nut 92 to the leg 88. A bolt or set screw 98 extends through the nut 92 for clamping the guide member 36 against the side of the square tubing 68.

The set screw arrangement 90 provides several very advantageous features for the form brace 26 of this invention. First, the set screw 98 is quickly and easily tightened against the guide member 36 with a simple wrench. Second, the connection between the strut 32 and the base 28 is quite solid and clearly sufficiently substantial to meet the requirements of concrete form braces. Third, the connection 78 is infinitely adjustable between its extreme positions so that any angle adjustment, however small, can be effected.

Installation and use of the concrete form braces 26 of this invention should now be apparent. At the site of the foundation 10, the excavation 12 is made in accordance with the plan of the foundation 10. The form lumber 20, 22 is installed about the periphery of the foundation 10 and the form supports 30 are nailed thereto with the nails 62. The bases 28 of each of the braces 26 is positioned away from the forms 20, 22 and the stakes 42 driven into the ground to immobilize the base 28. The strut 32 is then positioned relative to the base 28 so that the form support 30 holds the form lumber 20, 22 at the desired angle. With the strut 32 in its desired position, a workman tightens the set screw 98 to clamp the guide member 36 against the tubing 68. The form braces 26 are spaced about the periphery of the foundation 10 as may be required by the load imparted to the forms 20, 22. After the concrete 24 is poured and set up, the form braces 26 and form lumber 20, 22 are removed merely by pulling up the stakes 42 and extracting the nails 52.

As shown in FIGS. 3, 4 and 5, the metal tubing 68 is on the side of the wall 36 opposite from the openings 38 so that the set screw 98 is on the same side of the wall 36 as the openings 38. This is the preferred arrangement since the set screw 98 interferes with the stakes 42 at only two possible positions. If the connection 78 were reversed so that the set screw 98 were on the opposite side of the wall 36 from the openings 38, it will be seen that the tubing 68 could interfere with the forward stake 42 in a rather wide range of angular positions of the strut 32.

Although the invention has been described in its preferred forms with a certain degree of particularity, it is understood that the present disclosure is only by way of example and that numerous changes in the details of construction and in the combination and arrangement of parts may be resorted to without departing from the spirit and scope of the invention as hereinafter claimed.

I claim:

1. An improved form brace for supporting a concrete form relative to the earth, comprising an L-shaped based having a generally planar base member providing a long dimension and having openings therethrough for receiving a stake for securing the base to the earth and a single elongate upstanding vertical wall perpendicular to the base member extending parallel to the long dimension and providing resistance against banding in a plane parallel to the vertical wall;

a form support pivotally connected to the base member for rotation about an axis generally perpendicular to the vertical wall;

a strut comprising a length of metal tubing having one side providing one arm of a downwardly facing U-shaped structure and a bracket having one leg secured to the tubing and a second downwardly extending leg providing another arm of the U-shaped structure, the strut being pivotally connected, adjacent one end thereof, to form support and having an adjustable connection comprising the U-shaped structure straddling the vertical wall, at the other end thereof, and slidably supported on the upstanding vertical wall; and a set screw threaded through the U-shaped structure for abutting the vertical wall and securing the U-shaped structure to the vertical wall at substantially any location therealong.

2. The improved form brace of claim 1 wherein the base comprises a metal angle having a first generally planar section comprising the base member and a second generally planar section, perpendicular to the first section, comprising the vertical wall.

3. The improved form brace of claim 2 wherein the form support comprises a pair of metal angles providing first generally planar sections residing in a common plane, each of the first planar sections providing a series of vertically spaced openings therethrough for receiving fasteners for securement to the concrete form, the strut comprising a length of metal tubing pivotally received, at one end thereof, between the pair of metal angles.

4. The improved form brace of claim 1 wherein the base includes at least one first passage comprising the stake receiving means and at least one second passage smaller than the first passage for receiving a fastener for securing the brace to lumber beneath the form brace.

5. The improved form brace of claim 1 wherein the strut is of fixed length.

6. The improved form brace of claim 2 wherein the form brace includes a metal angle providing a first generally planar section providing a series of vertically spaced openings therethrough for receiving fasteners for securement to the concrete form, the strut comprising a length of metal section pivotally connected to the form brace.

7. An improved form brace for supporting a concrete form relative to the earth, comprising an L-shaped base having a generally planar base member providing a long dimension and having openings therethrough for receiving a stake for securing the base to the earth and a single elongate upstanding vertical wall perpendicular to the base member extending parallel to the long dimension and providing resistance against bending in a plane parallel to the vertical wall;

a form support pivotally connected to the base member for rotation about an axis generally perpendicular to the vertical wall;

a strut pivotally connected, adjacent one end thereof, to the form support and having an adjustable connection comprising a downwardly generally U-shaped structure straddling the vertical wall, at the other end thereof, and slidably supported on the upstanding vertical wall, the U-shaped structure comprising a section of square tubing and an angle welded thereto having a planar section spaced from the square tubing to provide the generally U-shaped structure; and a set screw threaded through the U-shaped structure for abutting the vertical wall and securing the U-shaped structure to the vertical wall at substantially any location therealong.

* * * * *